US009093057B2

(12) United States Patent
Mejia

(10) Patent No.: US 9,093,057 B2
(45) Date of Patent: Jul. 28, 2015

(54) ALL IN ONE GUITAR

(71) Applicant: Luis Mejia, Miami Beach, FL (US)

(72) Inventor: Luis Mejia, Miami Beach, FL (US)

( * ) Notice: Subject to any disclaimer, the term of this patent is extended or adjusted under 35 U.S.C. 154(b) by 0 days.

(21) Appl. No.: 14/249,477

(22) Filed: Apr. 10, 2014

(65) Prior Publication Data

US 2015/0059561 A1 Mar. 5, 2015

Related U.S. Application Data

(60) Provisional application No. 61/873,177, filed on Sep. 3, 2013.

(51) Int. Cl.
*G10D 1/08* (2006.01)
*G10H 1/02* (2006.01)

(52) U.S. Cl.
CPC ... *G10H 1/02* (2013.01); *G10D 1/08* (2013.01)

(58) Field of Classification Search
CPC ..... G10D 1/08; G10H 1/02
See application file for complete search history.

(56) References Cited

U.S. PATENT DOCUMENTS

| | | | | | |
|---|---|---|---|---|---|
| 2,500,172 | A | * | 3/1950 | Gillenwater | 84/723 |
| 3,194,870 | A | * | 7/1965 | Tondreau et al. | 84/726 |
| 3,296,916 | A | * | 1/1967 | Palmer | 84/1 |
| 3,357,291 | A | * | 12/1967 | Carmichael | 84/267 |
| 3,550,495 | A | * | 12/1970 | Shotmeyer | 84/267 |
| 3,781,451 | A | * | 12/1973 | Nolan | 84/723 |
| 3,821,475 | A | * | 6/1974 | McKechnie | 381/118 |
| 4,464,967 | A | * | 8/1984 | Trimborn | 84/743 |
| 5,007,324 | A | * | 4/1991 | DeMichele | 84/741 |
| 5,025,704 | A | * | 6/1991 | Davis | 84/723 |
| 5,056,400 | A | * | 10/1991 | Wachi et al. | 84/600 |
| D325,742 | S | * | 4/1992 | Phillips | D17/14 |
| 5,422,955 | A | * | 6/1995 | Guzman et al. | 381/77 |
| H1503 | H | * | 12/1995 | Threadgill | 84/723 |
| 5,693,898 | A | * | 12/1997 | Fishman | 84/267 |
| 5,744,744 | A | * | 4/1998 | Wakuda | 84/650 |
| 5,837,912 | A | * | 11/1998 | Eagen | 84/267 |
| 5,929,362 | A | * | 7/1999 | Oteyza | 84/723 |
| 6,605,765 | B1 | * | 8/2003 | Johnson | 84/267 |
| 6,995,311 | B2 | * | 2/2006 | Stevenson | 84/737 |
| 7,355,110 | B2 | * | 4/2008 | Nash | 84/601 |
| 7,518,055 | B2 | * | 4/2009 | Zartarian | 84/615 |
| 7,671,268 | B2 | * | 3/2010 | Nicoll | 84/718 |
| 7,818,078 | B2 | * | 10/2010 | Iriarte | 700/94 |
| 8,129,608 | B2 | * | 3/2012 | Lee | 84/741 |
| 8,389,835 | B2 | * | 3/2013 | Findley et al. | 84/267 |
| 8,481,832 | B2 | * | 7/2013 | Lloyd | 84/329 |
| 2005/0252363 | A1 | * | 11/2005 | Rockett | 84/723 |
| 2006/0000347 | A1 | * | 1/2006 | Preece | 84/741 |

(Continued)

*Primary Examiner* — Robert W Horn
(74) *Attorney, Agent, or Firm* — Kevin Keener; Keener and Associates P.C.

(57) ABSTRACT

The present invention includes a guitar comprising: a hollow body, the body having a top surface, a bottom surface, an upper end, a lower end, a first sidewall, and a second sidewall, the first and second sidewall connecting the top surface and the bottom surface, the top surface having a central opening; an equalizer, the equalizer integral to the body; a mixer, the mixer integral to the body; a microphone jack, the microphone jack integral to the body; an amplifier, the amplifier integral to the body; a battery compartment, the battery compartment integral to the body, an output board, the output board integral to the body; an auxiliary input, the auxiliary input integral to the body. Other embodiments of the guitar include an all in one onboard mixer, a wireless system including a wireless transmitter and wireless receivers and an output board.

20 Claims, 10 Drawing Sheets

(56) References Cited

U.S. PATENT DOCUMENTS

| | | | | |
|---|---|---|---|---|
| 2006/0156913 | A1* | 7/2006 | Fishman et al. | 84/743 |
| 2007/0180975 | A1* | 8/2007 | Paris et al. | 84/291 |
| 2008/0156180 | A1* | 7/2008 | Bagale | 84/743 |
| 2008/0184864 | A1* | 8/2008 | Holt et al. | 84/267 |
| 2008/0295676 | A1* | 12/2008 | Yamada | 84/741 |
| 2011/0211713 | A1* | 9/2011 | Cavallo-Romano | 381/118 |
| 2013/0145922 | A1* | 6/2013 | Shinoda et al. | 84/604 |
| 2014/0013929 | A1* | 1/2014 | El-Khadem et al. | 84/726 |
| 2015/0059561 | A1* | 3/2015 | Mejia | 84/737 |

* cited by examiner

ALL IN ONE GUITAR

PRIORITY

This application claims the benefit of U.S. Provisional Application Ser. No. 61/873,177, filed Sep. 3, 2013, the entire content of which is hereby incorporated by reference herein.

FIELD OF INVENTION

The present invention relates to guitars, and more specifically guitars which include several internal components.

BACKGROUND OF INVENTION

Solo guitarists performing for small groups of people must rely on large and expensive audio amplification systems to project their music. Further, if the soloist wishes to provide any type of background music or effects, they are also tasked with providing additional equipment, such as an amplifier, a preamp, a tuner, an equalizer, a mixer one or two speakers, a microphone, and provisions and any other type of equipment required to provide the desired effect. It becomes very difficult and tedious for the solo guitarist to attempt to play for a group of people under these circumstances.

Few attempts have been made to provide a solution to this issue. At one point, a guitar with a built in cassette player was developed. However, this device lacked any type of microphone or tuning ability, thus the sound quality remained poor. There have since been few attempts to provide an all-inclusive device to assist the solo artist in performing for a group of people. Thus there is a need for a device that overcomes the above listed and other disadvantages.

SUMMARY OF INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

To resolve the problems mentioned above, an object of the present invention is to provide a guitar comprising: a hollow body having a top and bottom surface, an upper and lower end, a first and second sidewall, the first and second sidewall connecting the top and bottom surface, the top surface having a central opening; an equalizer integral to the body; a mixer integral to the body; a microphone jack integral to the body; an amplifier integral to the body; a battery compartment integral to the body; an output board integral to the body; and an auxiliary input integral to the body.

It is further envisioned that the guitar has a neck which comprises a headstock, the neck engaging the upper end of the guitar body, the headstock engaging the neck and located opposite the guitar body. Further, it is envisioned that the guitar comprises: a plurality of strings engaging the headstock, extending the entire length of the neck, and engaging the body; a bridge located on the top surface of the body configured to hold the plurality of strings in place on the top surface of the body; and a pickup installed underneath the top surface of the body beneath the bridge.

The invention is also directed to a guitar comprising: a hollow body having a top and bottom surface, an upper and lower end, and a first and second sidewall which connect the top and bottom surface, wherein the top surface has a central opening; a neck having a top and bottom surface, an upper and lower end, the lower end of the neck engaging the upper end of the body; a headstock, engaging the neck and comprising the upper end of the neck; a plurality of strings engaging the headstock, spanning the entire length of the top surface of the neck, and engaging the body; a bridge located on the top surface of the body configured to hold the plurality of strings in place on the top surface of the body; an equalizer installed in the first sidewall of the body; a microphone installed in the first sidewall of the body; a mixer installed in the bottom surface of the body; an amplifier installed in the bottom surface of the body; an auxiliary contact integral to the body; at least one speaker installed in the top surface of the body; and a battery compartment installed in the bottom surface of the body containing batteries, wherein the batteries in the battery compartment supply power to the speaker, amplifier, equalizer, mixer, and microphone.

The pickup is mounted on the underside of the top surface beneath the bridge and configured to receive a musical input from the plurality of strings attached to the bridge and transmit to the equalizer as a pickup output. The equalizer is configured to receive the pickup output, adjust the levels of the frequencies, and transmit the pickup output to the mixer as an equalizer output. The microphone is configured to receive a vocal input from the user, and transmit the vocal input to the mixer as a microphone output. The auxiliary contact is configured to receive an input from an external source and transmit the input to the mixer as an auxiliary output.

The mixer is configured to receive the equalizer output, microphone output, and the auxiliary output, adjust the outputs to desired parameters, and transmit the outputs to the amplifier as a mixer output. The amplifier is configured to receive the mixer output, adjust it to the desired parameters, and transmit the output to the speaker as an amplifier output.

The invention is also directed to a guitar comprising: a hollow body having a top and bottom surface, an upper and lower end, a first and second sidewall, connecting the top and bottom surface, wherein the top surface has a central opening; a neck having a top and bottom surface, an upper and lower end, the lower end engaging the upper end of the body, the neck comprising a headstock, the headstock engaging the upper end of the neck, and the headstock located opposite the body; a plurality of strings which engage the headstock, span the entire length of the neck and engage the body; a bridge located on the top surface of the body and configured to hold the plurality of strings in place on the body; a pickup installed underneath the top surface of the body beneath the bridge; a microphone jack configured to receive a microphone; an output board installed in the bottom surface of the body; an auxiliary contact, integral to the body; an onboard guitar unit, installed in the first sidewall of the body comprising: an equalizer, a mixer, and an amplifier; and a battery compartment installed in the bottom surface of the body.

The pickup is configured to receive a musical input from the plurality of strings attached to the bridge and transmit the musical input to the onboard guitar unit as a pickup output. The microphone jack is configured to receive a microphone, and the microphone is configured to receive a vocal input and transmit the input to the onboard guitar unit as a microphone output. The auxiliary contact is configured to receive an input from an external source and transmit the input to the onboard guitar unit as an auxiliary output. The onboard guitar unit is configured to receive the microphone output, the pickup output, and the auxiliary output, and transmit each of the outputs to the equalizer, the equalizer is configured to receive the outputs, adjust the outputs as desired, and transmit each of the outputs to the mixer as equalizer outputs. The mixer is configured to receive the equalizer outputs, adjust the outputs as desired, and transmit the equalizer outputs to the amplifier as a mixer output, the amplifier is configured to receive the mixer output, and adjust the mixer output by the amplifier as desired.

The onboard guitar unit may be battery powered or powered by an AC source supplied from the output board.

In another embodiment of the present invention, the guitar comprises a wireless transmitter, the wireless transmitter configured to receive a signal from the onboard guitar unit and transmit the signal to at least one receiver, the at least one receiver placed on at least one external speaker.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

Figure 1:
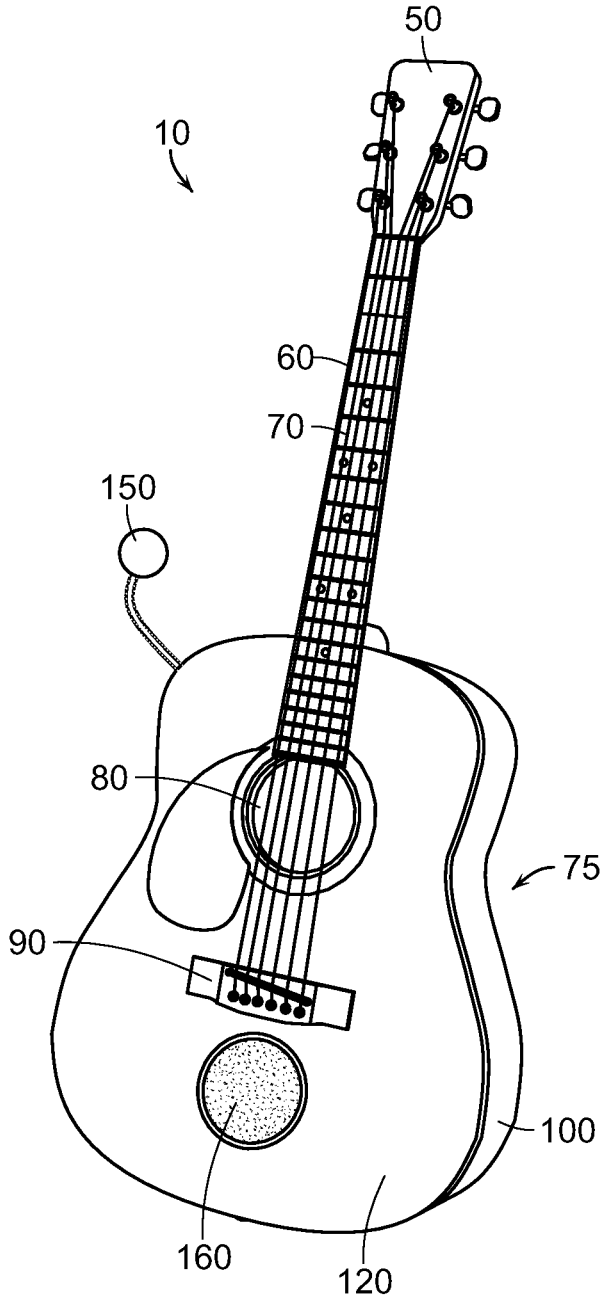
FIG. 1 is a frontal view of the guitar.

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

The invention described is directed to an acoustic guitar containing a plurality of built in components allowing for a single user to perform for an audience without having to provide and operate several external components. The guitar has several components integral to the body including a preamp/equalizer, a microphone, a battery compartment, an amplifier, and a speaker. FIG. 1-4 are directed to one embodiment of the present invention. In this embodiment, the guitar 10 is designed with an equalizer 140, a microphone 150, a speaker 160, a mixer 210, an amplifier 200, and an auxiliary contact 170. When a user plays the guitar 10, the musical input is received by the pickup 95, and transmitted to the equalizer 140 as a pickup output 145, where it can be adjusted to the desired parameters and then transmitted to the mixer 210. The user may also sing into the microphone 150, where the vocal input will be received and transmitted to the mixer 210 as a microphone output 155. The user can adjust the microphone output 155 and pickup output 145 to the desired parameters, at which point they are transmitted to the amplifier 200. Once the outputs are transmitted to the amplifier 200, they are sent to the speaker(s) 160, where the music is projected for an audience. The auxiliary contact 170 also allows a user to supply additional music to the guitar which is received by the mixer 210, and transmitted to the amplifier 200.

FIG. 1 is a frontal view of the guitar 10 in one embodiment of the present invention. In this embodiment, several of the features of the guitar 10 are shown. The guitar 10 may be any type which will accommodate the several integral components described including a nylon classical or steel stringed guitar. The present invention is directed to an acoustic guitar, but it is envisioned that any type of guitar suitable for accepting such components now known or later discovered is acceptable.

In this embodiment, the components and some of the built in features of the guitar 10 are portrayed. The guitar 10 is comprised of a neck 60, a headstock 50, a plurality of strings (strings) 70, a central recess 80, a bridge 90, and a body 75. The body 75 is hollow and is comprised of a top surface 120, a bottom surface (not shown), a first sidewall (not shown) and a second side wall 100. The top of the neck 60 is comprised of the headstock 50. The strings 70 are connected to the guitar 10 on the headstock 50 and span the entire length of the neck 60, ending at the bridge 90 of the guitar 10. The standard guitar has six strings but different variations from four strings up to eighteen string guitars are also available. The strings 70 may be constructed of metal, polymers, or animal or plant product materials. The strings 70 terminate at the bridge 90 of the guitar 10. The bridge 90 holds the strings 70 in place on the body 75. The bridge 90 may be of any design necessary to ensure proper operation of the guitar 10. The central recess 80, also known as a sound hole, resides beneath the strings 70, and assists in projecting the sounds from the guitar more effectively. The central recess 80 may be of any shape or design necessary to ensure proper operation of the guitar.

Additional components shown in FIG. 1 include the microphone 150 and a speaker 160. The microphone 150 is integral to the body 75 of the guitar 10. The microphone 150 receives vocal inputs from a user and transmits them to the mixer as a microphone output 155. The type of microphone used may be of different types or qualities depending on the desired design of the guitar 10. If a user desired a high quality or lower quality type of microphone, it is envisioned that the type of microphone desired could be replaced in the guitar.

There is a speaker 160 which is installed in the top surface 120 of the body 75. The speaker 160 in the embodiment shown is a five inch speaker and is designed to project music from the guitar 10. Any type of speaker may be used, including speakers of different diameters, quality, or shapes. Further, in other embodiments discussed below, additional speakers are placed in the guitar 10. One having skill in the art would understand that different types of guitars may require a different size or type of speaker. Different speakers of differing quality may be desired and installed depending on the purpose and price level of the guitar 10.

Figure 2:
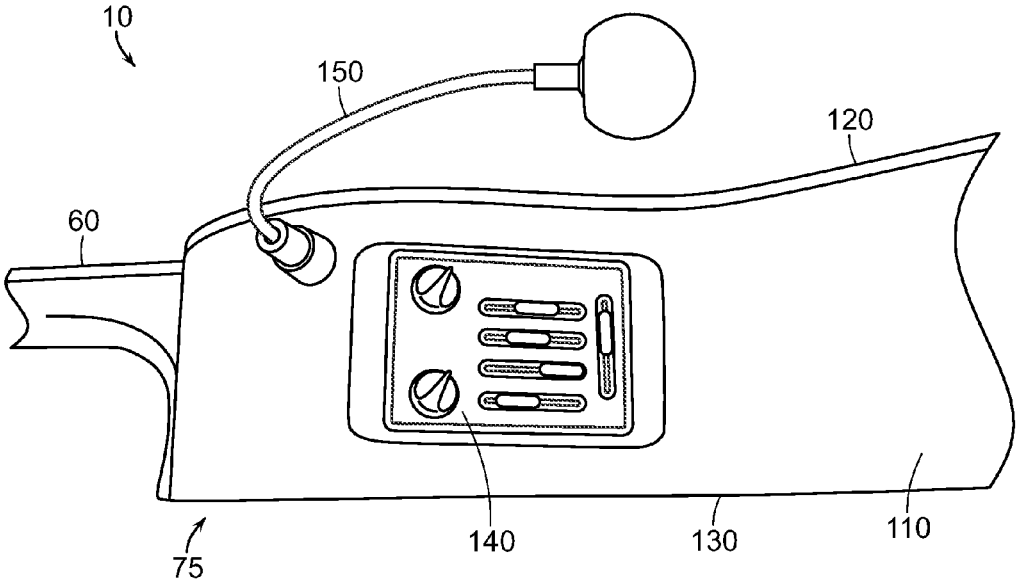
FIG. 2 is a side view of the guitar displaying one embodiment of the invention.

FIG. 2 is a side view of the guitar displaying one embodiment of the invention. This view portrays additional installed components integral to the guitar 10. Components shown in FIG. 2 include the first sidewall 110, the top surface 120 of the guitar 10, the bottom surface 130 of the guitar 10, the neck 60, the microphone 150, and the equalizer 140. In this embodiment, the user plays the guitar 10, and the pickup 95 (not shown) receives the musical input. The pickup transmits the input to the equalizer 140 as a pickup output 145 (not shown). The equalizer 140 is designed to receive pickup output, adjust the output and transmit the pickup output to the mixer 210 (not shown) as an equalizer output. The microphone 150 is designed to receive a vocal input from the user, and transmit the vocal input to the mixer 210 in the form of a microphone output 155 (not shown). The equalizer 140 shown in FIG. 2 is battery powered from the batteries 185 (not shown) in the battery compartment 180 (not shown). In this embodiment the equalizer 140 is an acoustic guitar preamp which includes a tuner. The equalizer 140 is configured to receive the pickup output 145 from the pickup 95, and adjust the output to the desired parameters by adjusting the low, middle, and high frequencies. This embodiment uses the configuration of the equalizer 140 described above, but it should be recognized, that there are several types of equalizer/preamp devices available which will provide the same type of function. One having skill in the art would understand that different types of devices serving the same purpose could be substituted in the guitar 10.

Figure 3:
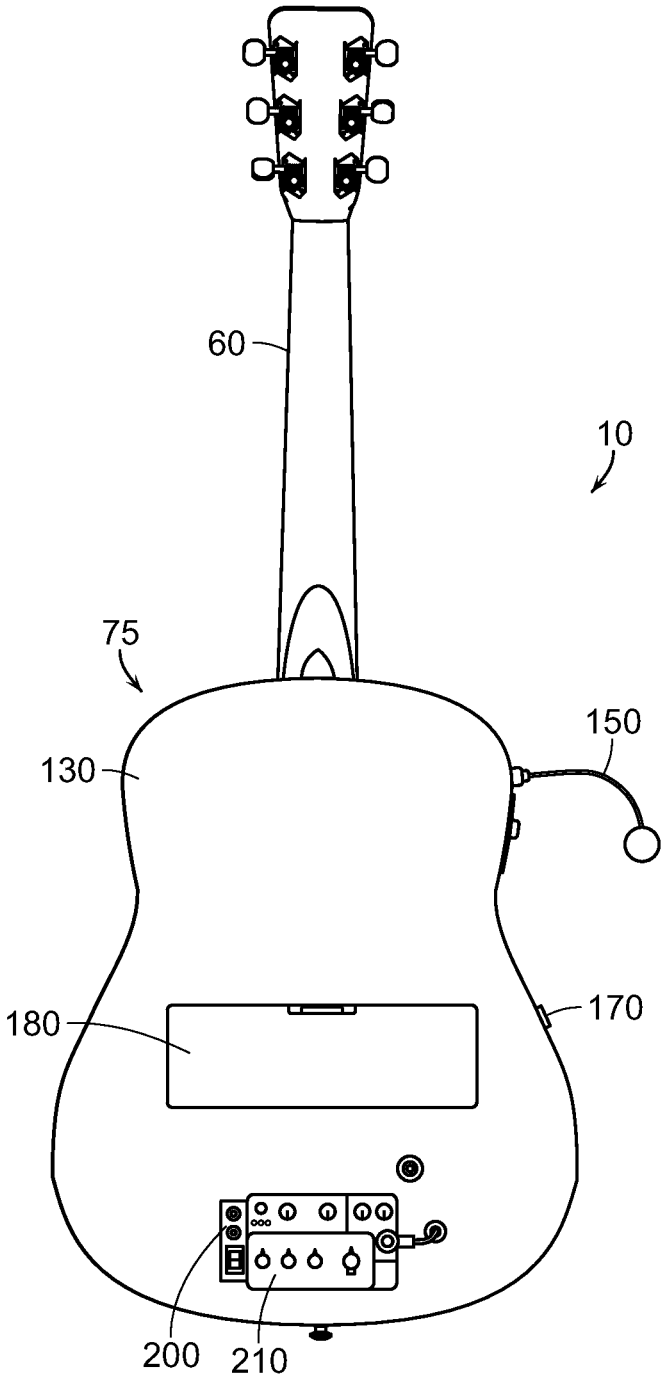
FIG. 3 is a rear perspective view of the guitar displaying one embodiment of the invention.

FIG. 3 is a rear perspective view of the guitar displaying one embodiment of the invention. In this embodiment, the bottom surface 130 of the guitar 10 comprises a battery compartment 180, designed to hold batteries 185 which supply power to the components of the guitar 10. Also contained in the bottom surface of the guitar 10 is the amplifier 200 and mixer 210. The mixer 210 receives the equalizer output from the equalizer 140, and transmits it to the amplifier 200. Also received by the mixer 210 is the vocal input, which is transmitted from the microphone 150 in the form of a microphone output 155. A user may also plug a device into the auxiliary contact 170, where it can be transmitted to the mixer 210 as well in the form of an auxiliary output. The auxiliary contact 170 is in this embodiment is a 3.5 mm jack which is designed to plug into an external device such as a smart phone, ipad, mp3 player, ipod, or other type of electronic device which accepts the connecter and feeds music to the mixer 210 for play by the guitar 10.

Figure 4:
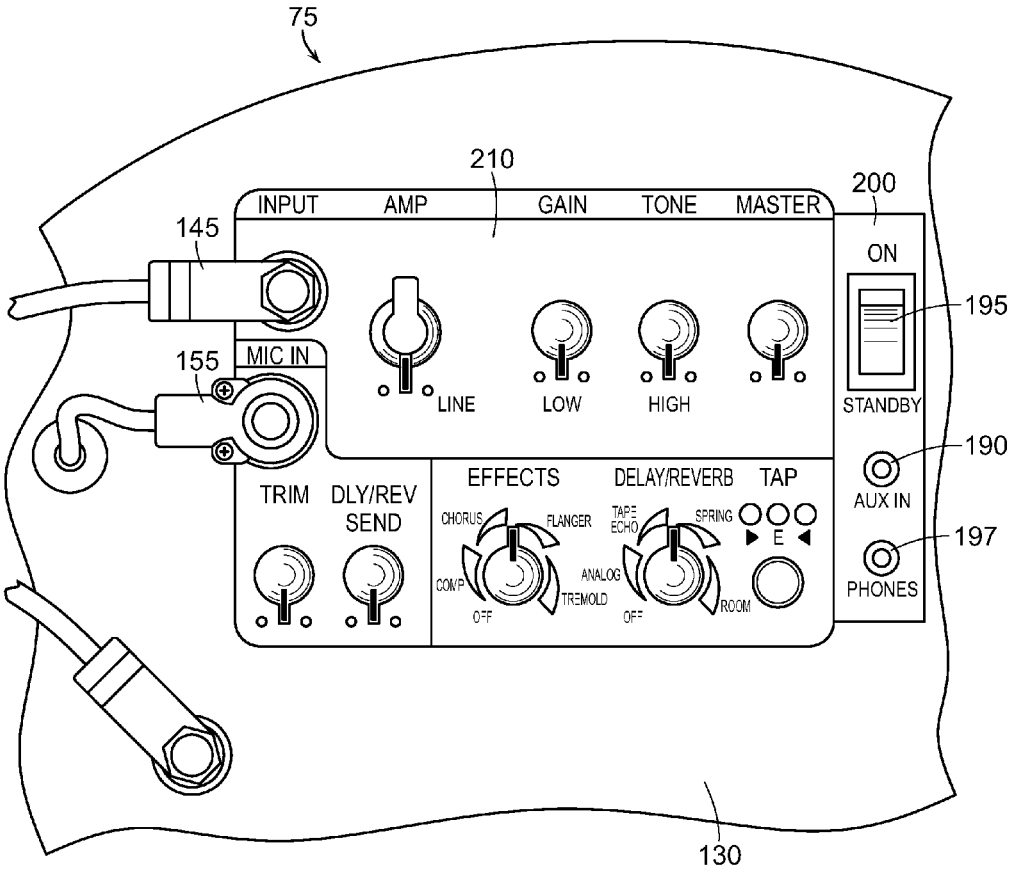
FIG. 4 is a detailed back view of the guitar displaying the embodiment in FIG. 3 of the invention.

Once the mixer 210 receives the outputs from the microphone, the equalizer and the auxiliary contact, the user can adjust the outputs to the desired parameters prior to transmitting them to the amplifier 200 as a mixer output. FIG. 4 is a detailed back view of the guitar displaying the embodiment in FIG. 3 of the invention. Shown in FIG. 4 is a detailed view of the amplifier 200 and mixer 210 installed in the bottom surface 130 of the guitar 10. The equalizer transmits the pickup output 145 to the mixer 210 where the parameters can be adjusted to the user's preferences. The microphone output 155 is also transmitted to the mixer 210 from the microphone 150, where the user can set the desired parameters for optimum sound quality prior to transmitting to the amplifier 200. The outputs are then fed into the amplifier 200 in the form of a mixer output. There is also a jack 197 for a user to plug in earphones. The unit may also be placed on standby by activating or deactivating the switch 195. As mentioned above, it should be recognized, that the mixer 210 and amplifier 200, and the schematics for providing the pickup output 145 and the microphone output 155 to them can be done in any number of ways desired for the design of the guitar. One having skill in the art would understand that several different combinations would suffice.

Figure 5:
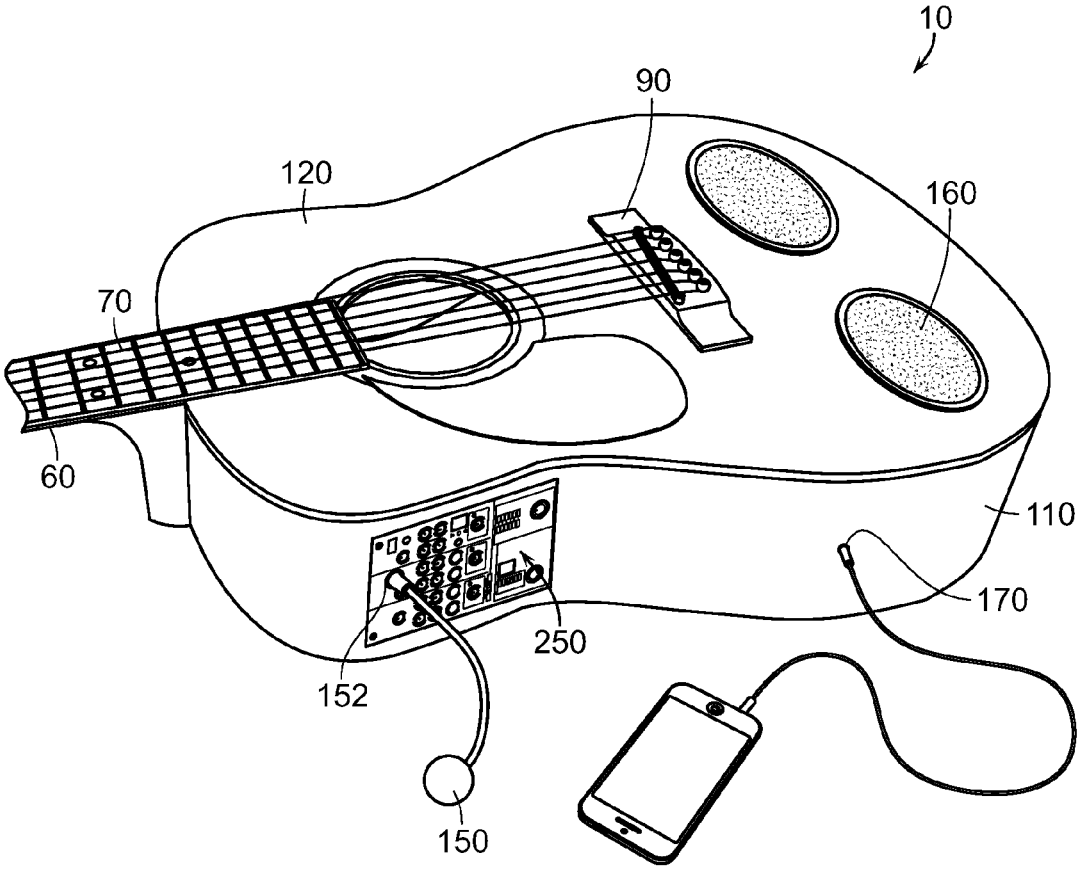
FIG. 5 is a side view of the guitar displaying another embodiment of the invention.
Figure 6:
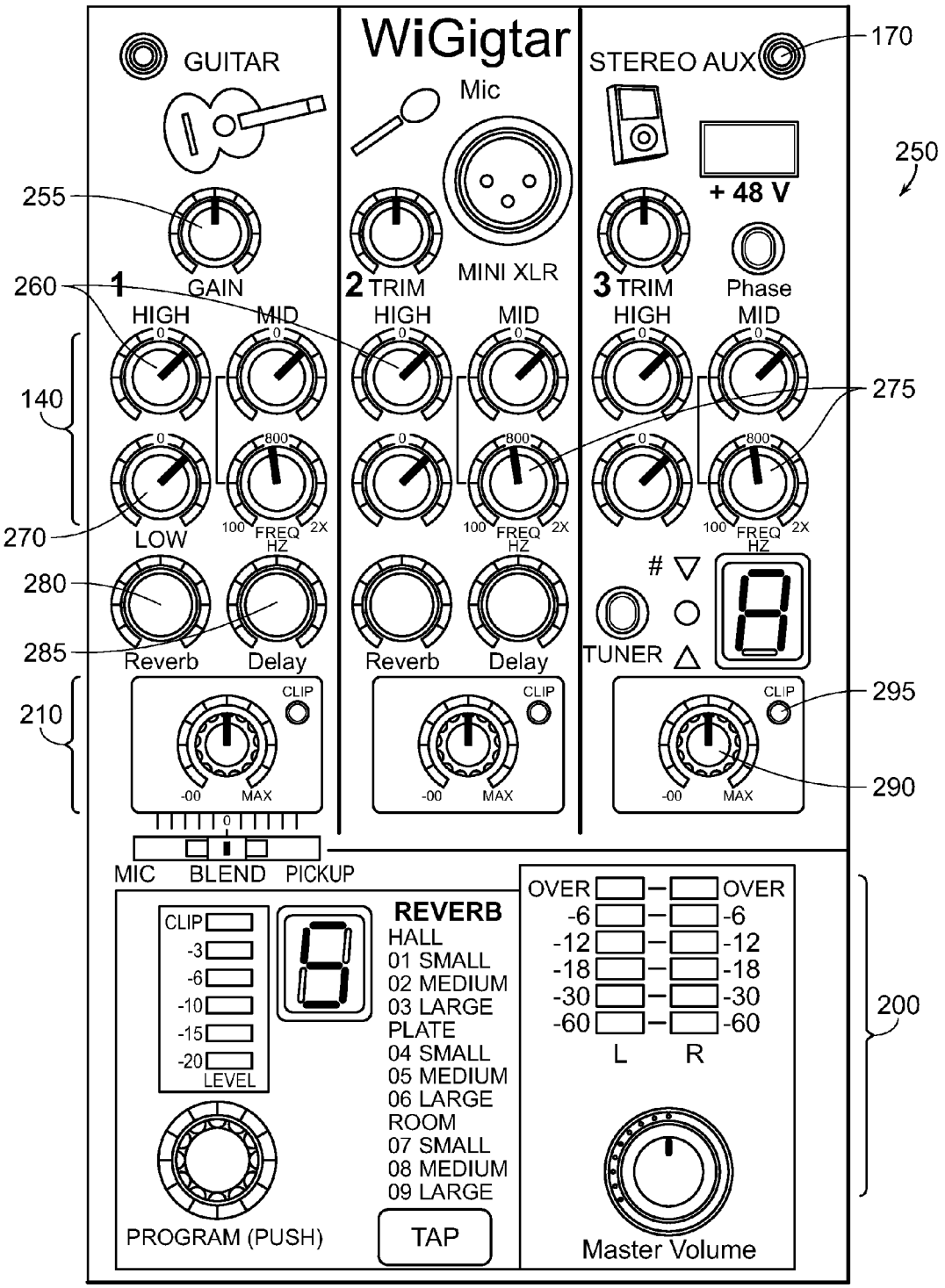
FIG. 6 is a detailed view of the guitar displaying an embodiment of the invention disclosed in FIG. 5.
Figure 7:
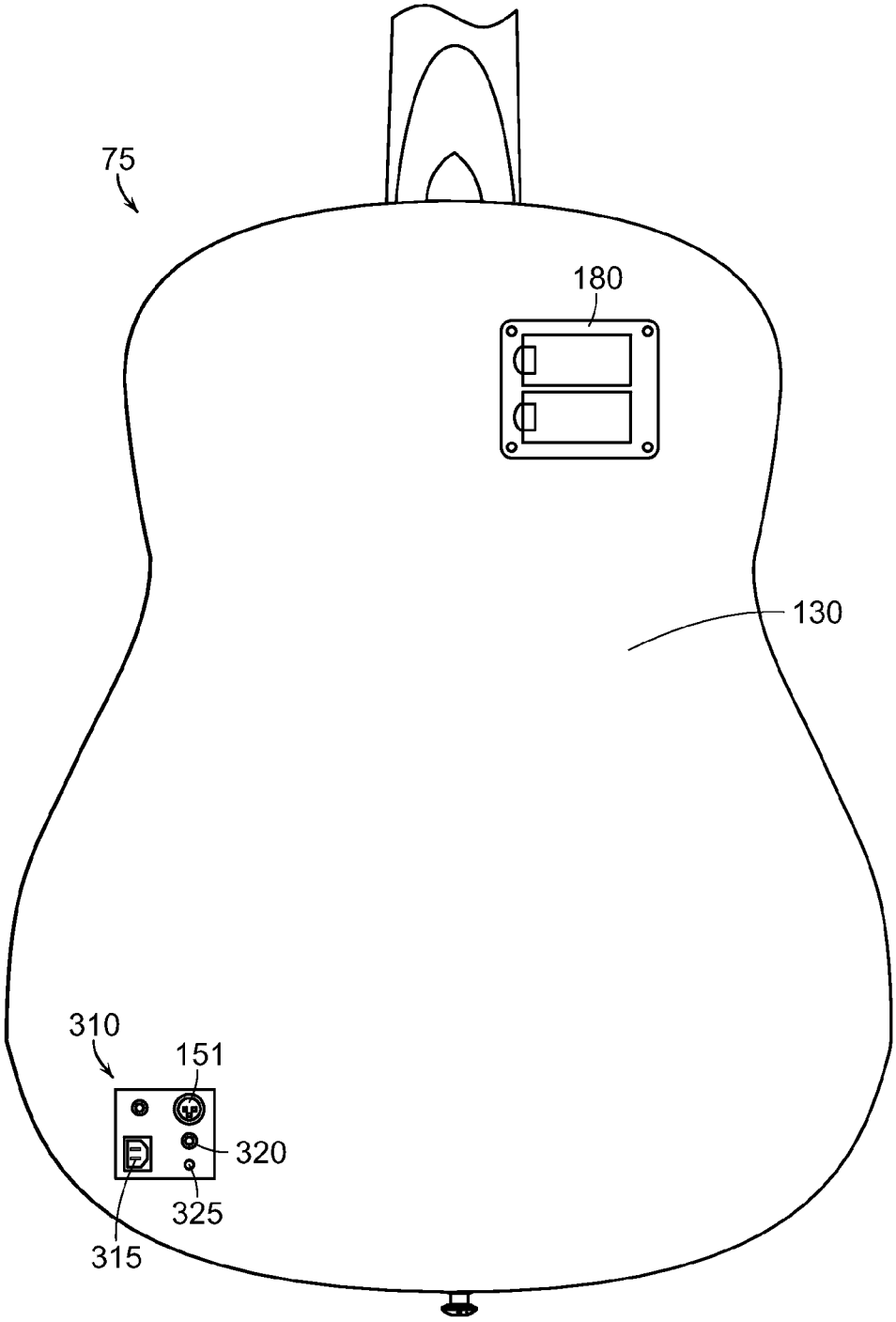
FIG. 7 is a rear view of the guitar displaying an embodiment of the invention

FIGS. 5-7 disclose another embodiment of the present invention. In this embodiment, several of the electronics are combined into a single onboard guitar unit 250 and installed in the first sidewall 110 of the guitar 10. There is also an additional output board 310 installed in the back of the guitar 10.

FIG. 5 is a side view of the guitar 10 displaying another embodiment of the invention. In this embodiment, the mixer 210, the amplifier 200, and the equalizer 140 are contained in the first sidewall 110 of the guitar 10 in an onboard guitar unit 250. The auxiliary contact 170 is also contained on the first sidewall 110 of the guitar 10. In this embodiment, there are two speakers 160 installed on the top surface 120 of the guitar 10.

The onboard guitar unit 250 is designed to receive the pickup output 145 from the pickup 95, the microphone output 155 from the microphone 150, and the auxiliary output from the external source. Once received, the onboard guitar unit 250 is configured to transmit the outputs to the equalizer 140 where the parameters can be adjusted, then the mixer 210 (contained in the unit) where the parameters can be adjusted, and then the amplifier 200 where the parameters can be adjusted (contained in the unit), and finally the speakers 160.

FIG. 6 is a detailed view of the guitar displaying an embodiment of the invention disclosed in FIG. 5. FIG. 6 shows details of the onboard guitar unit 250 which is installed in the first sidewall 110. The unit is compact and contains all of the components necessary to adjust the pickup output 145, the microphone output 155 and play the guitar 10. A user begins by playing the guitar 10, singing into the microphone 150 which is plugged into the jack 152, and plugging any external device into the auxiliary contact 170. The inputs are then transmitted to the onboard guitar unit 250. The onboard guitar unit 250 contains the mixer 210, the amplifier 200, and the equalizer 140. The pickup output 145, the auxiliary output, and the microphone output 155 feed into the onboard guitar unit 250 where they are fed to the equalizer 140. Once the outputs reach the equalizer 140, the outputs may be adjusted by the user using a gain or trim adjustment knob 255, a high frequency adjustment knob 260, a mid frequency adjustment knob 265, a low frequency adjustment knob 270 and the mid sweep frequency selection knob 275. The adjustments can be performed for each of the vocal, musical, and auxiliary inputs.

After being adjusted in the equalizer 140, the outputs are transmitted to the mixer 210 as equalizer outputs. The mixer 210 is also contained in the onboard guitar unit 250. A user can adjust the respective outputs with a plurality of mixer controls. In the mixer 210, the user can adjust the reverb with a reverb control knob 280, the delay with a delay control knob 285, and the channel gain with a channel gain knob 290. Each of the respective outputs from the equalizer are adjusted and controlled separately in the mixer 210 with a plurality of control knobs. The user can adjust the output signal level of each independent channel with the plurality of channel gain knobs 290. For instance, if the user desires to have the vocals of a song louder than the guitar, which in turn is louder than background music received from the auxiliary unit, then the user will adjust the channel gain knob 290 for the mic channel signal higher than the channel gain knob 290 for the guitar channel signal, which in turn is higher than the channel gain knob 290 for the auxiliary channel signal. The user may adjust and blend the three signals together in any manner that the user desires, promoting the signal for one channel over the others as the user desires. If the signal for one channel is promoted too much, a channel clip indicator 295 lights up to let the user know that the output signal for that channel is too high. The user can also adjust the settings of the reverb, such as whether the user desires a hall, plate or room setting. The mixer 210 may have a channel selection switch, which allows a user to allow only one channel signal to proceed to the speakers or blend the channel signals together and allow the blended signal to proceed to the speakers. The mixer 210 may also have a tuner which allows a user to ensure that the strings of the guitar 10 are in tune and play the proper note pitch.

The channel signals are then blended together and are then transmitted from the mixer 210 to the amplifier 200 as a mixer output signal. The user may adjust the master volume of each of the speakers using the amplifier 200. The user may also adjust the feed to the speaker(s) 160. The adjusted output is then transmitted from the amplifier to the speakers 160. Other features may be included in the onboard guitar unit 250 which would allow a user to adjust and vary any of the respective signals at any time. Such features may include a mute button to mute any or all of the signals, a power button, and signal effects such as distortion, chorus, phase, or flange. The onboard guitar unit 250 may be battery powered, or powered by an AC source.

FIG. 7 is a rear view of the guitar displaying an embodiment of the invention. The bottom surface 130 is shown, containing the battery compartment 180, which holds the batteries 185. In this embodiment, two nine volt batteries are used, but it is envisioned that any type of battery or power source may be used to supply power to the guitar 10. Further, in this embodiment, the battery compartment 180 is installed in the bottom surface 130, but it is envisioned that the battery compartment may be installed anywhere on the guitar 10 that serves the desired purpose of the user. Also shown in this embodiment is the output board 310. The output board 310 contains an AC adapter input 315 which allows the user to supply the components in the onboard guitar unit 250 with an AC power supply instead of using the batteries 185.

There is also an additional microphone input 151 for a headset microphone or extra microphone if needed. There is a headphone output 320 which allows a user to utilize an in-ear headphone to monitor the sound of the outputs. Finally, the output board 310 has a speaker mute button 325, which when pressed one time, mutes the speakers 160 on the guitar 10, but not the headphones output 320, so that the user may monitor the outputs from the amplifier 200 and adjust the signal settings without publicly projecting the sounds through the speakers 160. There is also a main stereo output available on the output board 310 which provides a user with option to connect external speakers 165 or an external amplifier to the guitar 10. The output board 310 described above is only one embodiment of the present invention. It is envisioned that the unit 310 may be supplied in many different variations as required by the user. One having skill in the art would understand that different requirements could be met with different designs, all of which serve the same or a similar purpose.

Figure 8:
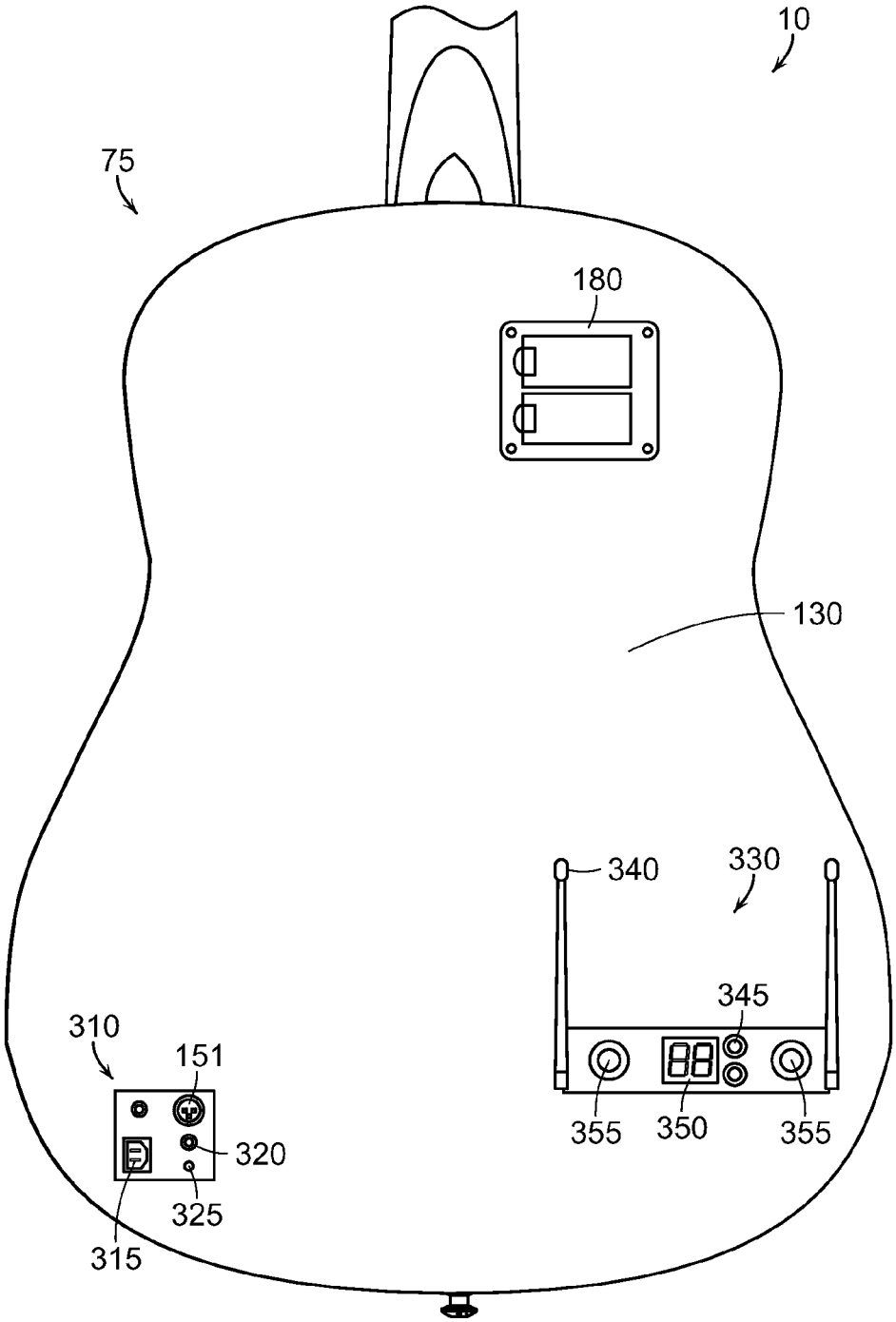
FIG. 8 is a rear view of the guitar displaying another embodiment of the invention.
Figure 9:
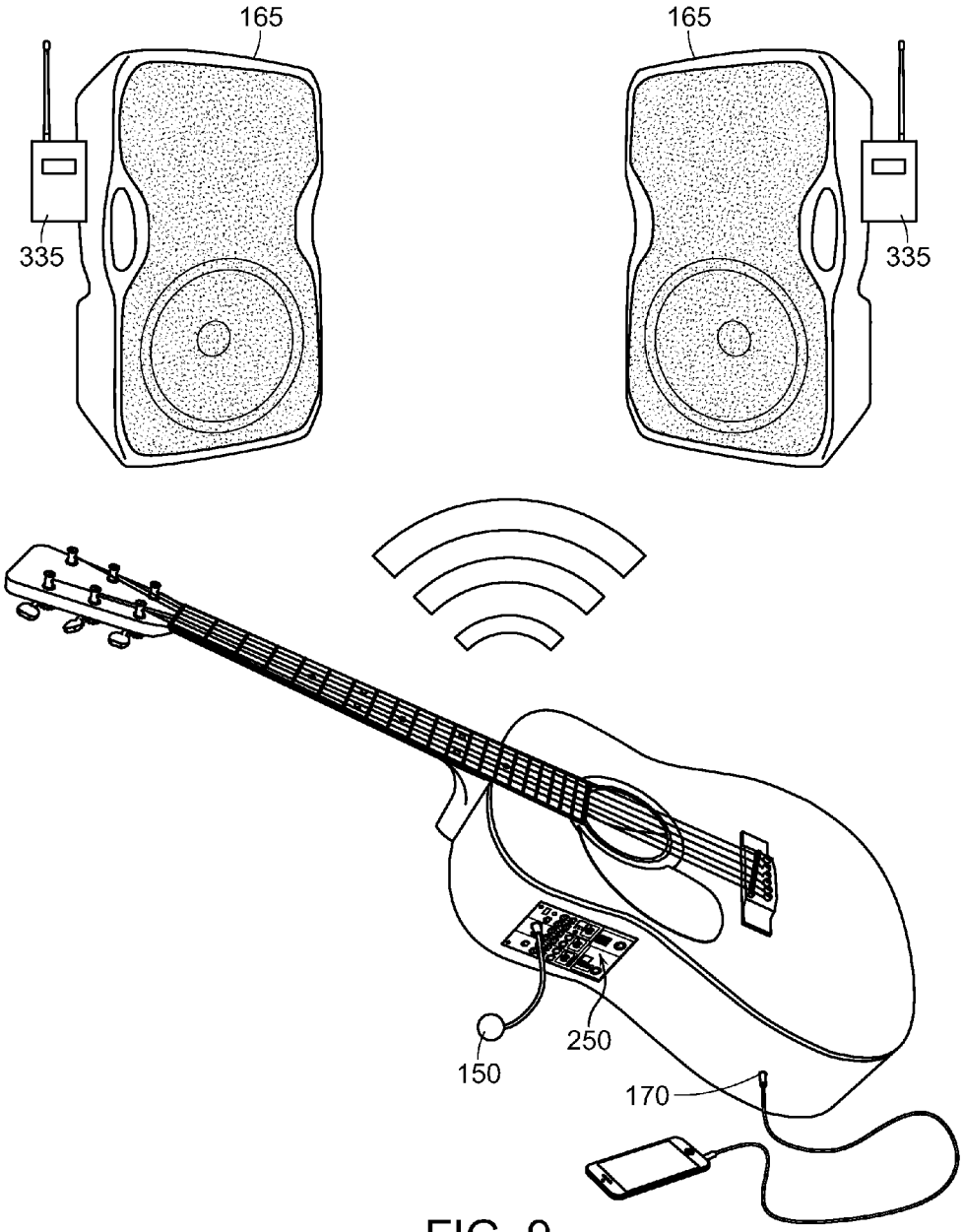
FIG. 9 is an overview of an embodiment of the invention.

FIGS. 8-9 detail another embodiment of the present invention. This embodiment envisions installing a wireless transmitter 330 in the guitar 10 which transmits the outputs from the onboard guitar unit 250 to at least one wireless receiver located on at least one wireless speaker 165 allowing the user to project the guitar outputs on the wireless speaker(s) 165. In this embodiment, the guitar 10 may have speakers 160 that are integral to the body of the guitar 10, or the guitar 10 may not have any speakers 160 that are integral to the body of the guitar.

FIG. 8 is a rear view of the guitar displaying another embodiment of the invention Shown in FIG. 8 is a view of the back of the guitar 10 which details a wireless transmitter 330. The wireless transmitter 330 allows the user to transmit the output from the guitar to a receiver located on external speakers 165 instead of having the music play from a speaker 160 installed the body 75 of the guitar 10. In this embodiment, a wireless transmitter 330 is installed in the bottom surface 130 of the guitar 10. The wireless transmitter 330 shown has connector antennas 340, channel number indicators 345 and a dual segment, LED display panel 350. The transmitter 330 also has volume adjustment knobs 355 for controlling the levels of the respective signals sent to the external speakers 165, and thus the volume of the external speakers 165. The wireless transmitter shown is installed on the bottom surface 130 of the guitar, but it is envisioned that it could be installed anywhere in the unit. Further, there are many different types of wireless transmitters available. Therefore, it should be understood that one having skill in the art could supply a different unit serving the same function depending on the design of the guitar.

FIG. 9 is an overview of an embodiment of the invention. In this embodiment, a wireless guitar system is shown. The wireless transmitter 330 (see FIG. 8) transmits a signal from the amplifier 200 to a wireless receiver 335 which can be located on one or more external speakers 165 to play the outputs from the guitar 10.

Figure 10:
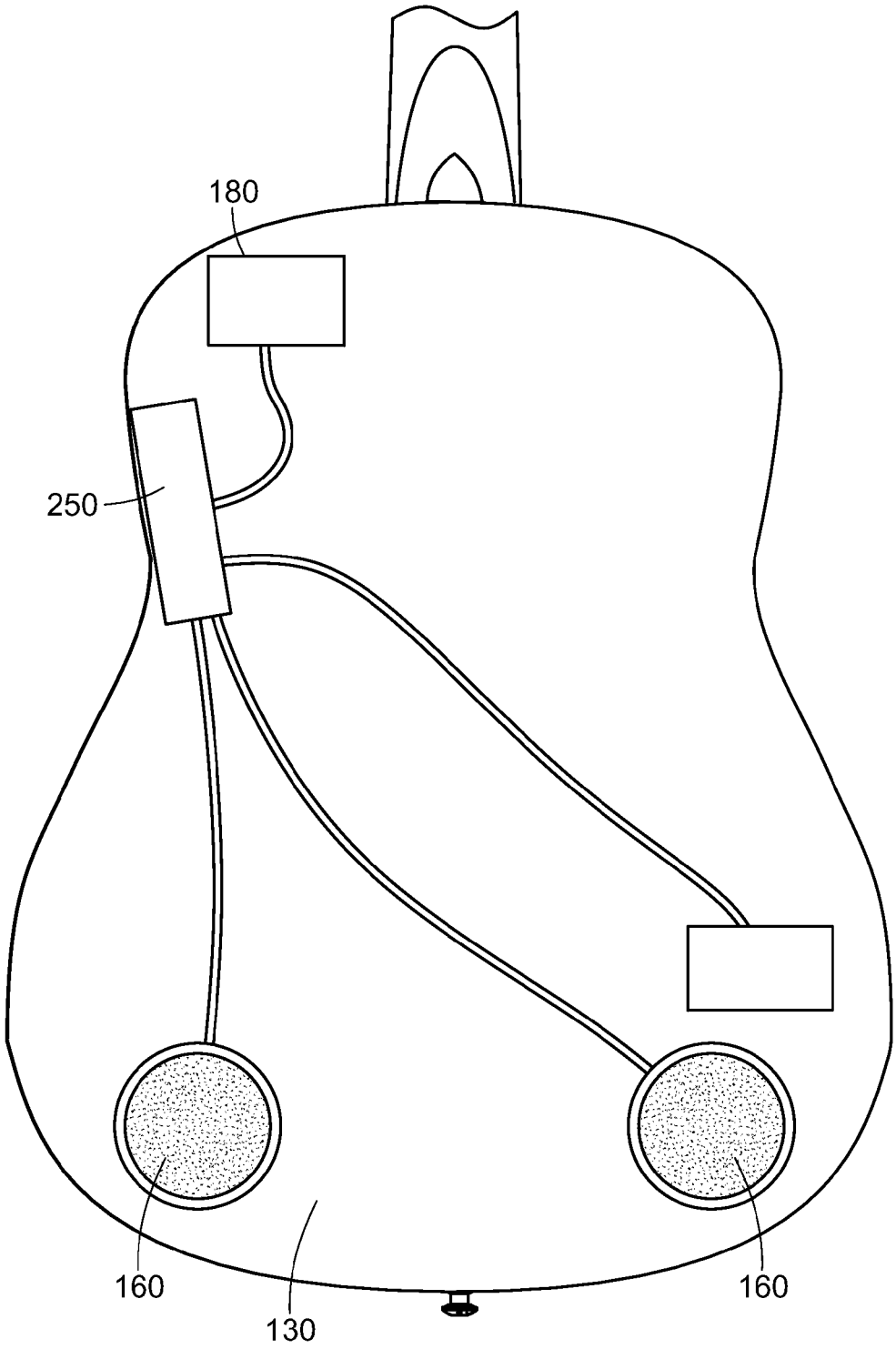
FIG. 10 is a rear view of the guitar displaying the wiring schematic of an embodiment of the invention.

FIG. 10 is a rear view of the guitar displaying the wiring schematic of an embodiment of the invention. In this embodiment, the battery compartment 180 containing the batteries 185, powers the onboard guitar unit 250 with two 9 volt batteries 185. The onboard guitar unit 250 is hardwired to the speakers 160 as well as the output board 310, and feeds the outputs to the appropriate units.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

| | |
|---|---|
| 10 | Guitar |
| 50 | Headstock |
| 60 | Neck |
| 70 | Strings |
| 75 | body |
| 80 | Recess |
| 90 | Bridge |
| 95 | Pickup |
| 100 | Second sidewall |
| 110 | First sidewall |
| 120 | Top surface |
| 130 | Bottom surface |
| 140 | Equalizer |
| 145 | Pickup output |
| 150 | Microphone |
| 152 | Microphone jack |
| 155 | Microphone output |
| 160 | Speaker |
| 170 | Auxiliary Jack |
| 180 | Battery compartment |

-continued

| | |
|---|---|
| 185 | Batteries |
| 195 | On/standby button |
| 197 | Earphone input |
| 200 | amplifier |
| 210 | Mixer |
| 250 | Onboard Guitar Unit |
| 255 | Trim Knob |
| 300 | Mute button |
| 305 | Power |
| 310 | Output board |
| 315 | Ac adapter input |
| 320 | Headphones output |
| 325 | Speaker mute button |
| 330 | Wireless transmitter |
| 340 | Connector antennas |
| 345 | Channel number indicator |

What is claimed is:

1. A guitar comprising a. A body, said body having a top surface, a bottom surface, an upper end, a lower end, a first sidewall, and a second sidewall, said first and second sidewall connecting said top surface and said bottom surface;

b. a neck, said neck having a top surface, a bottom surface, an upper end and a lower end, said lower end engaging said upper end of said body i. wherein said neck comprises a headstock, said headstock engaging said upper end of said neck, said headstock located opposite said body;

c. A plurality of strings i. wherein said plurality of strings engage said headstock, said plurality of strings span the entire length of said neck and engage said body;

ii. a bridge, said bridge located on said top surface of said body, said bridge configured to hold said plurality of strings in place on said top surface of said body;

d. A microphone jack i. said microphone jack integral to said body;

ii. said microphone jack configured receive a microphone signal;

e. A pickup i. said pickup is integral to said body;

ii. said pickup is configured to receive a musical input from said plurality of strings and generate an electric musical signal;

f. An auxiliary input i. said auxiliary input integral to said body;

ii. Said auxiliary input configured to receive an auxiliary signal from an external source;

g. A microphone control set i. Said microphone control set integral to said body;

ii. Said microphone control set comprising a group of controls configured to permit a user to select parameters for modifying said microphone signal;

iii. Said microphone control set configured to modify said microphone signal in accordance with user selected parameters and generate a modified microphone signal;

h. A musical control set i. Said musical control set integral to said body;

ii. Said musical control set comprising a group of controls configured to permit a user to select parameters for modifying said musical signal;

iii. Said musical control set configured to modify said musical signal in accordance with user selected parameters and generate a modified musical signal;

i. An auxiliary control set i. Said auxiliary control set integral to said body;

ii. Said auxiliary control set comprising a group of controls configured to permit a user to select parameters for modifying said auxiliary signal;

iii. Said auxiliary control set configured to modify said auxiliary signal in accordance with user selected parameters and generate a modified auxiliary signal.

2. The guitar as in claim 1 further comprising a. A battery compartment i. Said battery compartment integral to said body.

3. The guitar as in claim 1 further comprising a. Wherein said modified microphone signal, said modified musical signal, and said modified auxiliary signal are combined into an output signal.

4. The guitar as in claim 1 further comprising a. One or more speakers i. Said one or more speakers integral to said body.

5. The guitar as in claim 1 a. Wherein said microphone control set, said musical control set, and said auxiliary control set are contained in a single master control panel.

6. The guitar as in claim 1 a. Wherein said microphone control set comprises a plurality of knobs;

b. Wherein said musical control set comprises a plurality of knobs;

c. Wherein said auxiliary control set comprises a plurality of knobs.

7. The guitar as in claim 1 further comprising a. An amplifier unit i. Said amplifier integral to said body;

ii. Wherein said amplifier unit is configured to receive said modified microphone signal, said modified music signal, and said modified auxiliary signal;

iii. Wherein said amplifier unit transmits said modified microphone signal, said modified music signal, and said modified auxiliary signal to one or more speakers integral to said body.

8. The guitar as in claim 1 further comprising a. A wireless transmitter i. Said wireless transmitter integral to said body;

ii. Said wireless transmitter configured to receive said modified microphone signal, said modified music signal, and said modified auxiliary signal and transmit said signals to one or more external receivers connected to one or more external speakers.

9. The guitar as in claim 1 further comprising a. A headphone output jack i. Said headphone output jack integral to said body;

ii. Said headphone output jack configured to send an output signal to headphones worn by a user of the guitar.

10. The guitar as in claim 2 further comprising a. One or more speakers i. Said one or more speakers integral to said body.

11. The guitar as in claim 10 further comprising a. An amplifier unit i. Said amplifier integral to said body;

ii. Wherein said amplifier unit is configured to receive said modified microphone signal, said modified music signal, and said modified auxiliary signal;

iii. Wherein said amplifier unit transmits said modified microphone signal, said modified music signal, and said modified auxiliary signal to said one or more speakers.

12. The guitar as in claim 11 a. Wherein said microphone control set comprises a plurality of knobs;

b. Wherein said musical control set comprises a plurality of knobs;

c. Wherein said auxiliary control set comprises a plurality of knobs.

13. The guitar as in claim 12 further comprising a. A wireless transmitter i. Said wireless transmitter integral to said body;

ii. Said wireless transmitter configured to receive said modified microphone signal, said modified music signal, and said modified auxiliary signal and transmit said signals to one or more external receivers connected to one or more external speakers.

14. The guitar as in claim 13 a. Wherein said microphone control set, said musical control set, and said auxiliary control set are contained in a single master control panel.

15. The guitar as in claim 14 further comprising a. A headphone output jack i. Said headphone output jack integral to said body;

ii. Said headphone output jack configured to send an output signal to headphones worn by a user of the guitar.

16. A master control panel for installation on a guitar comprising a. A guitar control set, said guitar control set configured to receive a guitar input signal, said guitar control set comprising i. Frequency modification controls configured to modify the frequency parameters of said guitar input signal;

ii. A guitar signal level control configured to modify the output level of said guitar input signal;

b. A microphone control set, said microphone control set configured to receive a microphone input signal, said microphone control set comprising i. Frequency modification controls configured to modify the frequency parameters of said microphone input signal;

ii. A microphone signal level control configured to modify the output level of said microphone input signal;

c. An auxiliary control set, said auxiliary control set configured to receive an auxiliary input signal, said auxiliary control set comprising i. Frequency modification controls configured to modify the frequency parameters of said auxiliary input signal;

ii. An auxiliary signal level control configured to modify the output level of said auxiliary input signal;

d. Wherein said master control panel is integral to the body of a guitar;

e. Wherein said master control panel generates a master control output signal.

17. The master control panel of claim 16 a. Wherein said guitar control set further comprises a reverb control;

b. Wherein said microphone control set further comprises a reverb control;

c. Wherein said auxiliary control set further comprises a reverb control.

18. The master control panel of claim 17 further comprising a. A master volume control, said master volume control configured to modify the output level of said master control panel.

19. The master control panel as in claim 18 further comprising a. A guitar signal clip indicator light;

b. A microphone signal clip indicator light;

c. An auxiliary signal clip indicator light.

20. A guitar comprising a. A body, said body having a top surface, a bottom surface, an upper end, a lower end, a first sidewall, and a second sidewall, said first and second sidewall connecting said top surface and said bottom surface;

b. a neck, said neck having a top surface, a bottom surface, an upper end and a lower end, said lower end engaging said upper end of said body i. wherein said neck comprises a headstock, said headstock engaging said upper end of said neck, said headstock located opposite said body;

c. A plurality of strings i. wherein said plurality of strings engage said headstock, said plurality of strings span the entire length of said neck and engage said body;

ii. a bridge, said bridge located on said top surface of said body, said bridge configured to hold said plurality of strings in place on said top surface of said body;

d. A microphone jack i. said microphone jack integral to said body;

ii. said microphone jack configured receive a microphone signal;

e. A pickup i. said pickup is integral to said body;

ii. said pickup is configured to receive a musical input from said plurality of strings and generate an electric musical signal;

f. An auxiliary input i. said auxiliary input integral to said body;

ii. Said auxiliary input configured to receive an auxiliary signal from an external source;

g. A means for independently modifying the parameters and level of said microphone signal to generate a modified microphone signal;

h. A means for independently modifying the parameters and level of said musical signal to generate a modified musical signal;

i. A means for independently modifying the parameters and level of said auxiliary signal to generate a modified auxiliary signal.

* * * * *